US005456474A

United States Patent [19]

Geshkewich

[11] Patent Number: 5,456,474

[45] Date of Patent: Oct. 10, 1995

[54] FOLDING HOLDER BINGO CARDS WITH DETACHABLY ADHESIVE COVER

[76] Inventor: Jacqueline Geshkewich, 2733 Elder La., Franklin Park, Ill. 60131

[21] Appl. No.: 164,755

[22] Filed: Dec. 10, 1993

[51] Int. Cl.[6] ..... A63F 3/06

[52] U.S. Cl. ..... 273/269; 273/282.2; 273/285; 273/309; 40/159.2

[58] Field of Search ..... 273/157 A, DIG. 14, 273/269, 270, 285, 286, 282.1, 282.2; 446/487, 488, 901; 434/393; 40/365, 124, 124.4, 155, 156, 158.1, 157, 159.2; 206/44 B, 579, 315.1, 425

[56] References Cited

U.S. PATENT DOCUMENTS

| | | | |
|---|---|---|---|
| 2,872,215 | 2/1959 | Taylor | 273/286 |
| 3,811,680 | 5/1974 | Benesch | 273/309 |
| 4,133,536 | 1/1979 | Cole | 273/309 |
| 4,618,151 | 10/1986 | Fadner et al. | 273/269 |
| 4,767,119 | 8/1988 | Fadner et al. | 273/282.2 |
| 5,286,025 | 2/1994 | Mulyca et al. | 273/309 |

*Primary Examiner*—V. Millin
*Assistant Examiner*—William M. Pierce

[57] ABSTRACT

A new and improved holder for supporting a plurality of bingo cards during play comprising, a flat rectangular base of a thin flexible material of a size to receive a rectangular array of a plurality of rows of bingo cards and a plurality of columns of bingo cards, the base having linear rows of score lines and four linear columns of score lines corresponding to the rows and columns between bingo cards when on the base; a flat rectangular cover sheet of a thin flexible, transparent material of a width to cover the width of the base and of a height greater than the height of the base; attachment means coupling the top edge of the base to the top edge of the cover sheet with the bottom edge of the cover sheet extending beneath the bottom edge of the base and folded there under; a reusable adhesive layer secured between the base and the bingo cards on the base and adapted to secure a plurality of bingo cards on the base between the perforations.

3 Claims, 3 Drawing Sheets

FOLDING HOLDER BINGO CARDS WITH DETACHABLY ADHESIVE COVER

BACKGROUND OF THE INVENTION

1. Field of the Invention

The present invention relates to a holder for supporting a plurality of bingo cards and more particularly pertains to a flexible foldable support including a base and a cover sheet for use by bingo players for laying out a plurality of bingo cards during play.

2. Description of the Prior Art

The use of bingo card holders is known in the prior art. More specifically, holders for an array of bingo cards heretofore devised and utilized for the purpose of rendering a plurality of bingo cards readily accessible during play are known to consist basically of familiar, expected and obvious structural configurations, notwithstanding the myriad of designs encompassed by the crowded prior art which have been developed for the fulfillment of countless objectives and requirements.

Various devices for use and association with playing bingo are disclosed in the prior art. Note for example, U.S. Pat. Nos. 3,811,630 to Benesch and 4,630,830 to Gadd. These patents disclose devices for holding a plurality of bingo cards in rows and columns.

In addition, U.S. Pat. No. 4,291,382 to Del Monte discloses a support for holding a rigid base with mounted bingo cards in a generally vertical orientation as does U.S. Pat. No. Des. 271,895 to Runions.

In this respect, the holder for supporting a plurality of bingo cards according to the present invention substantially departs from the conventional concepts and designs of the prior art, and in so doing provides an apparatus primarily developed for the purpose of rendering a plurality of bingo cards readily accessible during play.

Therefore, it can be appreciated that there exists a continuing need for new and improved holder for supporting a plurality of bingo cards which can be readily utilized during play and conveniently stored and/or retrieved. In this regard, the present invention substantially fulfills this need.

SUMMARY OF THE INVENTION

In view of the foregoing disadvantages inherent in the known types of bingo card holders now present in the prior art, the present invention provides an improved holder for supporting a plurality of bingo cards. As such, the general purpose of the present invention, which will be described subsequently in greater detail, is to provide a new and improved holder for supporting a plurality of bingo cards apparatus and method which has all the advantages of the prior art and none of the disadvantages.

To attain this, the present invention essentially comprises a new and improved holder for supporting a plurality of bingo cards in a fixed orientation with respect to each other during play comprising, in combination a plurality of bingo cards adapted for simultaneous use during the play of a bingo game; a flat rectangular base of a thin plastic material of a size to receive a rectangular array of five rows of bingo cards and five columns of bingo cards, the base having four linear rows of perforations and four linear columns of perforations corresponding to the rows and columns between bingo cards when located upon the base; a flat rectangular cover sheet of a thin plastic material of a width to cover the width of the base and of a height greater than the height of the base; attachment means coupling the top edge of the base to the top edge of the cover sheet with the bottom edge of the cover sheet extending beneath the bottom edge of the base and folded beneath the bottom edge of the base; a reusable adhesive layer secured between to the base and the bingo card upon the base and adapted to secure a plurality of bingo cards on the base between the rows and columns of perforations during the play of a bingo game.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is another object of the present invention to provide a new and improved holder for supporting a plurality of bingo cards which may be easily and efficiently manufactured and marketed.

It is a further object of the present invention to provide a new and improved holder for supporting a plurality of bingo cards which is of a durable and reliable construction.

An even further object of the present invention is to provide a new and improved holder for supporting a plurality of bingo cards which is susceptible of a low cost of manufacture with regard to both materials and labor, and which accordingly is then susceptible of low prices of sale to the consuming public, thereby making such holder for supporting a plurality of bingo cards economically available to the buying public.

Still yet another object of the present invention is to provide a new and improved holder for supporting a plurality of bingo cards which provides in the apparatuses and methods of the prior art some of the advantages thereof, while simultaneously overcoming some of the disadvantages normally associated therewith.

Still another object of the present invention is to support an array of bingo cards for playing in an efficient, convenient and economical manner.

Yet another object of the present invention is to store, transport and retrieve a device for holding a plurality of bingo cards for use during the play of bingo games.

Even still another object of the present invention is to provide a new and improved holder for supporting a plurality of bingo cards during play comprising a flat rectangular base of a thin flexible material of a size to receive a rectangular array of a plurality of rows of bingo cards and a plurality of columns of bingo cards, the base having linear rows of perforations and four linear columns of perforations corresponding to the rows and columns between bingo cards when on the base; a flat rectangular cover sheet of a thin flexible, transparent material of a width to cover the width of the base and of a height greater than the height of the base; attachment means coupling the top edge of the base to the top edge of the cover sheet with the bottom edge of the cover sheet extending beneath the bottom edge of the base and folded there under; a reusable adhesive layer secured between the base and the bingo cards on the base and adapted to secure a plurality of bingo cards on the base between the perforations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
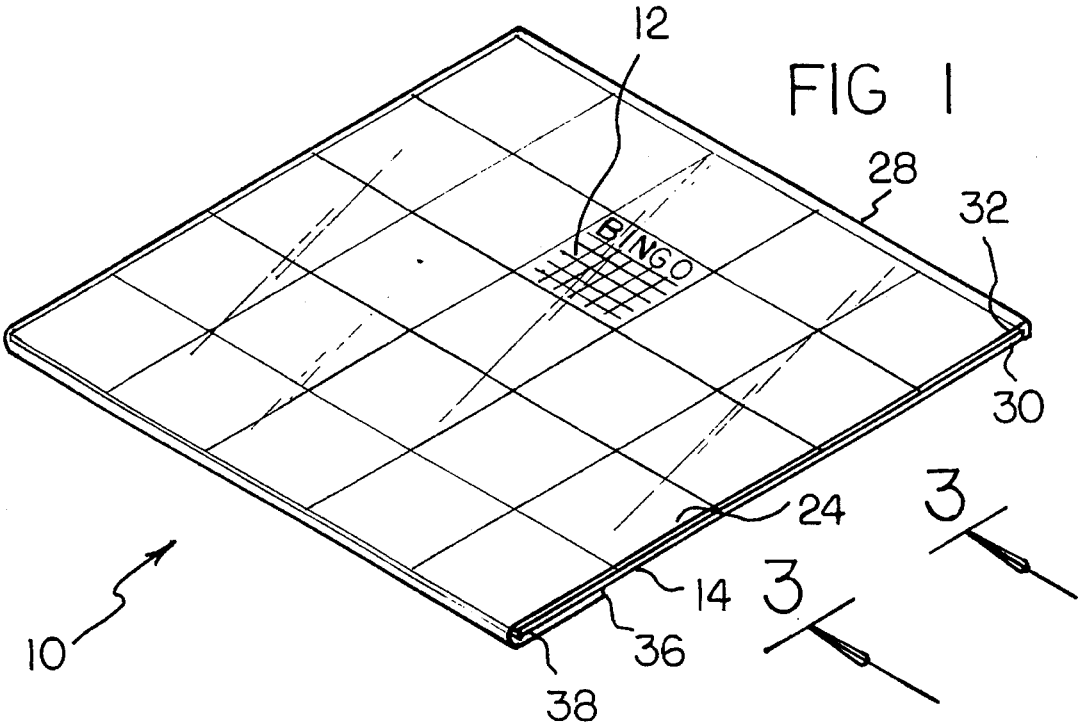
FIG. 1 is a perspective view of the holder for supporting a plurality of bingo cards constructed in accordance with the principles of present invention.
Figure 2:
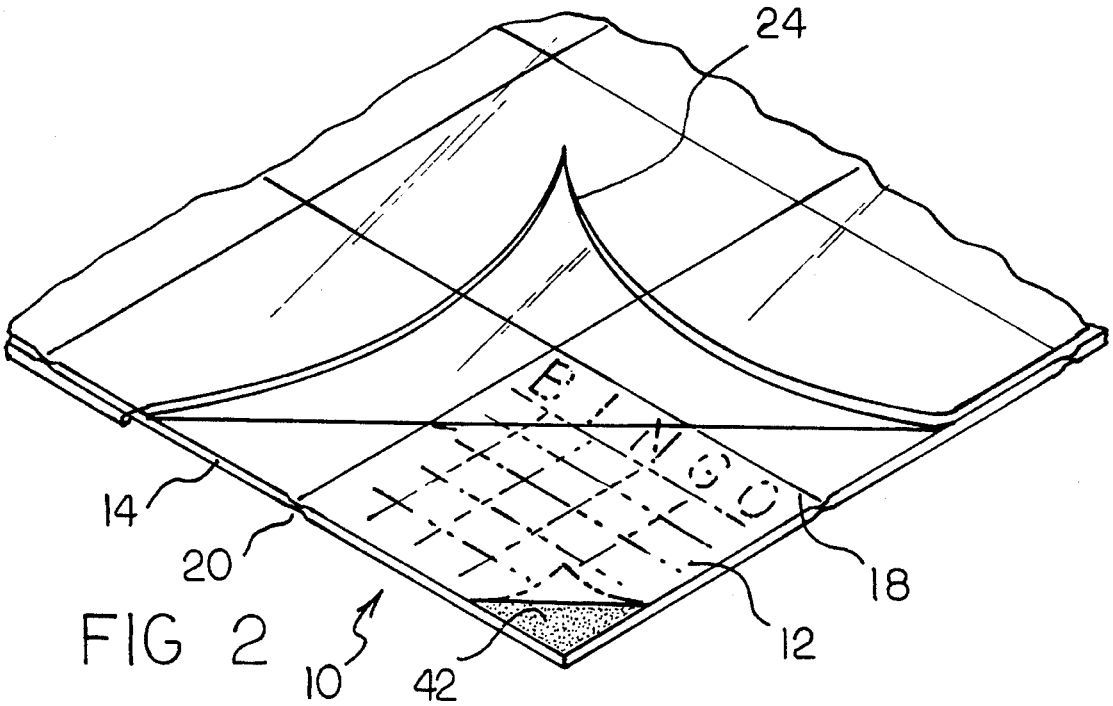
FIG. 2 is an enlarged perspective view of the device shown in FIG. 1 with parts removed to show certain internal constructions.
Figure 3:
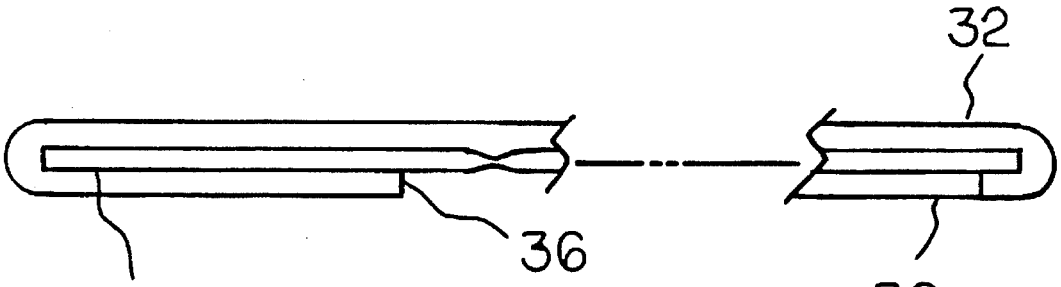
FIG. 3 is a sectional view taken along line 3—3 of FIG. 1.
Figure 4:
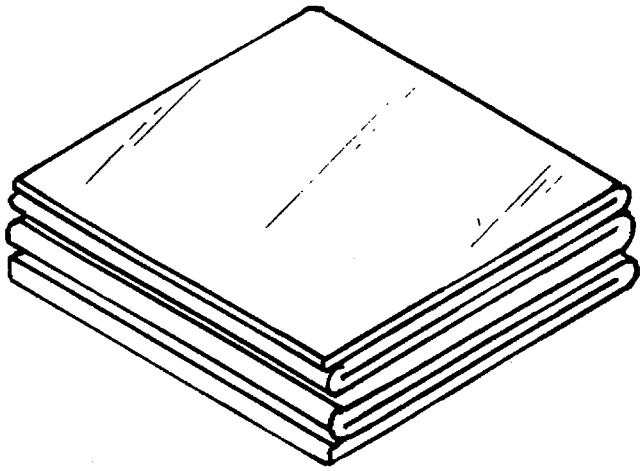
FIG. 4 shows the device of FIG. 1 but in the folded orientation prior to or following use.

With reference now to the drawings, and in particular to FIG. 1 thereof, a new and improved holder for supporting a plurality of bingo cards embodying the principles and concepts of the present invention and generally designated by the reference numeral 10 will be described.

More specifically, it will be noted that the present invention, particularly the primary embodiment thereof is readily seen in FIGS. 1 through 4. The invention is in a new and improved holder device 10. Such holder functions for supporting a plurality of bingo cards 12 during play of bingo games. The holder comprises, in combination, a flat rectangular base 14. The base is fabricated of a thin flexible plastic material. It is of a size and shape to receive a rectangular;array of five horizontal rows of bingo cards and five vertical columns of bingo cards. Note FIG. 1.

The base 14 has four linear horizontal rows of perforations 18 and four linear vertical columns of linear recesses perforations 20. The perforations are shown generally schematically in the various Figures but are intended to be formed as rows or series of aligned holes, as those between postage stamps, to allow easy separation of the parts on opposite sides of the perforations. The perforations correspond in size and location to the rows and columns between bingo cards 12 when on the base during play of a bingo game. The linear recesses or perforations function as fold lines to facilitate the folding of the base along such lines formed thereby. With the device being folded along the linear recesses or perforations, the folded device is rendered more susceptible for storage and transportation.

Used in association with the base 14 is a flat rectangular cover sheet 24. The cover sheet is fabricated of a thin, flexible, transparent material. It is of a width to cover the width of the base 14. It is and of a height greater than the height of the base 14.

Attachment means 28 couple the top edge 30 of the base 14 to the top edge 32 of the cover sheet 24. A permanent adhesive is perferably used for this purpose. The bottom edge 36 of the cover sheet 24 extends beneath the bottom edge 38 of the base 14. Such bottom edge 36 of the cover sheet 24 is folded there under the bottom edge 38 of the base to secure the cover sheet to the base and the bingo cards therebetween.

A reusable adhesive layer 42 is secured between the base and the bingo cards 12, preferably on the upper surface of the base. The adhesive layer 42 is adapted to secure a plurality of bingo cards 12 on the base between the perforations 18 and 20 during the play of a bingo game. The bingo cards are thus in an array of five rows and five columns, twenty five cards in total, for ease of play. Marking of called numbers and erasure of such marks is done on the cover sheet and not on the cards themselves. The reusable adhesive layer 42 may be made of any of a large number of commercially available materials for such purpose. Typical of such materials are those commercially available as well as those disclosed in the patent literature for such purpose of adhering sheet material of the type disclosed herein. Consider, for example, U.S. Pat. No. 3,931,666 to Karami; U.S. Pat. No. 4,929,401 to Shippen; and U.S. Pat. No. 4,959,265 to Wood.

Figure 5:
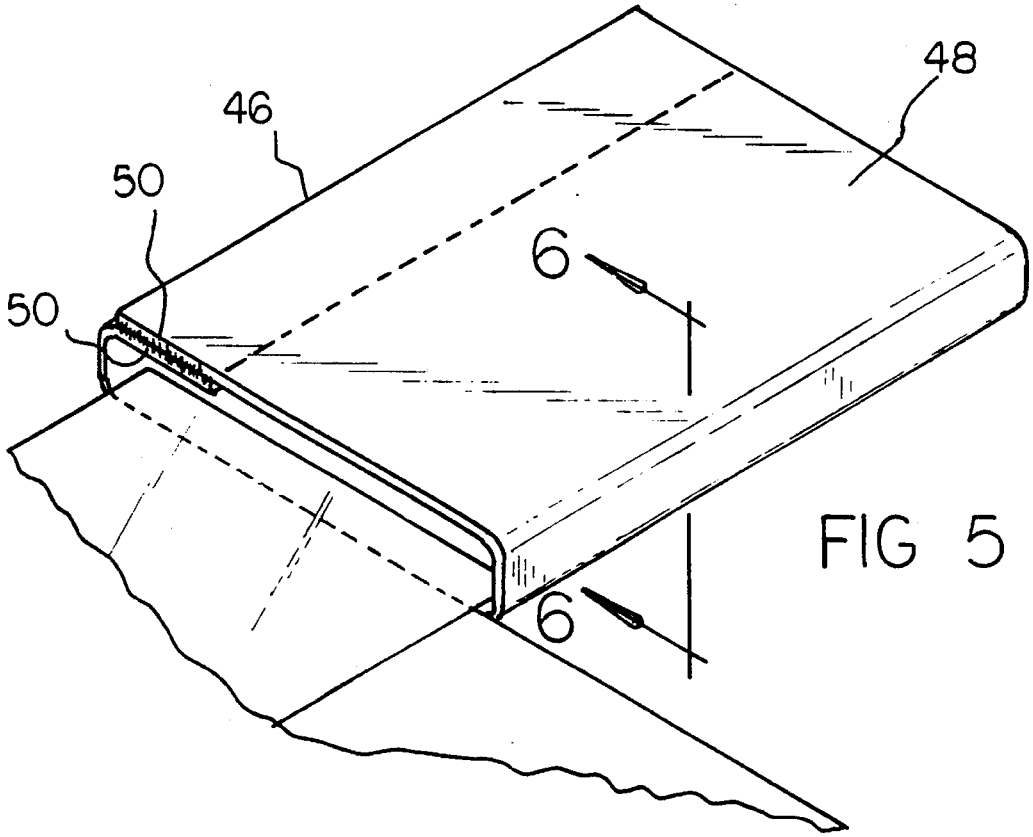
FIG. 5 is a perspective illustration of a pouch for receiving the device of the prior Figures.
Figure 6:
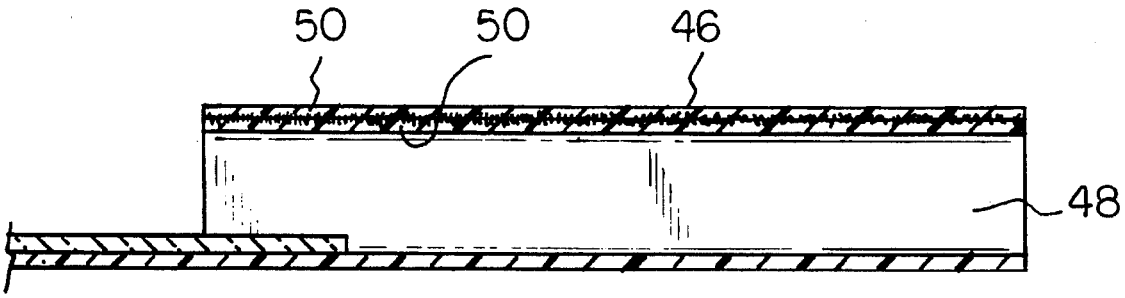
FIG. 6 is a sectional view taken along line 6—6 of FIG. 5.

An alternate embodiment of the invention is shown in FIGS. 5 and 6. According to such alternate embodiment the invention further includes a pouch 46 provided for receipt of the device 10. The pouch is used by first folding the base 14 and cover sheet 24 about the perforations lines. Supplemental flexible plastic material 48 is coupled with respect to the base and cover sheet. Cooperable pieces of a pile type fastener 50 are attached to the ends of the material 48 to allow such material to selectively form a pouch 46 into which the device may be positioned.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved holder for supporting a plurality of bingo cards in a fixed orientation with respect to each other during play comprising, in combination:

a plurality of bingo cards adapted for simultaneous use during the play of a bingo game;

a flat rectangular base of a thin plastic material of a size to receive a rectangular array of five rows of bingo cards and five columns of bingo cards, the base having four linear rows of perforations and four linear columns of perforations corresponding to the rows and columns between bingo cards when located upon the base;

a flat rectangular cover sheet of a thin plastic material of a width to cover the width of the base and of a height greater than the height of the base;

attachment means coupling a top edge of the base to a top edge of the cover sheet with an opposite bottom edge of the cover sheet extending beneath an opposite bottom edge of the base and folded beneath the bottom edge of the base to contact a back portion of the base; and a reusable adhesive layer secured between the base and the bingo card upon the base and adapted to secure a plurality of bingo cards on the base between the rows and columns of perforations during the play of a bingo game.

2. A new and improved holder for supporting a plurality of bingo cards during play comprising:

a flat rectangular base of a thin flexible material of a size to receive a rectangular array of a plurality of rows of bingo cards and a plurality of columns of bingo cards, the base having linear rows of perforations and four linear columns of perforations corresponding to the rows and columns between bingo cards when on the base;

a flat rectangular cover sheet of a thin flexible, transparent material of a width to cover the width of the base and of a height greater than the height of the base;

attachment means coupling a top edge of the base to a top edge of the cover sheet with an opposite bottom edge of the cover sheet extending beneath an opposite bottom edge of the base and folded beneath the bottom edge of the base to contact a back portion of the base; and a reusable adhesive layer secured between the base and the bongo cards on the base and adapted to secure a plurality of bingo cards on the base between the perforations.

3. The apparatus as set forth in claim 2 and further including a pouch for receipt of the base and cover sheet when folded about the perforation lines.

* * * * *